US005794771A

United States Patent [19]

Krawec et al.

[11] Patent Number: 5,794,771

[45] Date of Patent: Aug. 18, 1998

[54] PACKAGE FOR COMPONENTS OF HAND MADE CIGARETTES

[75] Inventors: Marek S. Krawec, Richmond Hill; Edward G. A. Simpson, Aurora; Jean L. Mailhot, Hawksbury, all of Canada

[73] Assignee: Rothmans, Benson & Hedges, Inc., Ontario, Canada

[21] Appl. No.: 840,704

[22] Filed: Apr. 25, 1997

[51] Int. Cl.[6] ..... B65D 81/22

[52] U.S. Cl. ..... 206/223; 206/236; 206/256; 206/804; 312/31.1

[58] Field of Search ..... 206/223, 236–242, 206/248, 256, 265, 270, 804; 220/528; 312/31, 31.1–31.3

[56] References Cited

U.S. PATENT DOCUMENTS

| | | | |
|---|---|---|---|
| 890,196 | 6/1908 | Surbrug . | |
| 1,291,454 | 1/1919 | Fay, Jr. . | |
| 1,678,260 | 7/1928 | Martino et al. . | |
| 1,830,591 | 11/1931 | Clark . | |
| 1,904,777 | 4/1933 | Brzezicki | 206/237 |
| 1,920,193 | 8/1933 | Gary | 206/236 |
| 1,938,384 | 12/1933 | Hauch . | |
| 1,938,385 | 12/1933 | Hauch . | |
| 1,982,446 | 11/1934 | Murray . | |
| 2,072,630 | 3/1937 | Ferry . | |
| 2,506,385 | 5/1950 | Roamer | 206/236 |
| 2,561,805 | 7/1951 | Lombard . | |
| 2,671,707 | 3/1954 | Lombard . | |
| 2,831,571 | 4/1958 | Erbel | 206/237 |
| 3,144,152 | 8/1964 | Kopp . | |

FOREIGN PATENT DOCUMENTS

| | | | |
|---|---|---|---|
| 348564 | 3/1935 | Canada . | |
| 900382 | 5/1972 | Canada | 190/1 |
| 1072895 | 3/1980 | Canada | 190/26.7 |

*Primary Examiner*—Jimmy G. Foster
*Attorney, Agent, or Firm*—Banner & Witcoff, Ltd.

[57] ABSTRACT

The invention relates to a packaging system for hand made cigarettes using loose tobacco and pre-made, filter tipped cigarette tubes. The packaging system includes a reusable container with a bottom section and a top section. Loose tobacco is stored in the bottom section and is separated by a divider from the top section. A removable storage canister holds the empty cigarette tubes and fits within the top portion of the reusable container.

6 Claims, 3 Drawing Sheets

PACKAGE FOR COMPONENTS OF HAND MADE CIGARETTES

SCOPE OF THE INVENTION

This invention relates to a packaging system for domestic hand made cigarettes using fine cut loose tobacco and pre-made filter tipped cigarette tubes. The packaging system includes a reusable canister in which loose tobacco may be provided in the bottom. Preferably, a removable divider separates the loose tobacco from a container of cigarette tubes placed on top of the divider. The canister with lid removed provides ready access to permit removal of the container of cigarette tubes. The large space within the canister and above the tobacco provides a working space in which loose tobacco may be picked up and selected for purposes of use in a device for hand-making finished cigarettes. Preferably, the container for the pre-made filter tipped cigarette tubes supports the tubes on their filter tips when positioned in the canister on e top of the divider.

BACKGROUND OF THE INVENTION

There are several well recognized advantages in hand made cigarettes. Aside from the obvious cost advantage, hand made cigarettes offer the consumer the opportunity to customize X cigarette to their own prefer for tobacco weight, firmness, draw resistance and the like. Two drawbacks associated with hand made cigarettes are the inability or difficulty in positioning of a filter on the end of the band made cigarette and the appearance. These two problems were overcome by pre-made filter tipped cigarette tubes which can be loaded with tobacco by use of, for example, a device described in U.S. Pat. No. 4,771,793 and sold under the trade-mark SUSSEX.

A convenient kit for packaging loose tobacco and cigarette tubes comprises the tobacco in a separate foil sealed container and a box or boxes of filter tipped cigarette tubes. The tobacco container includes a separate lid with optional moistening strip where the foil seal once removed is discarded. The cigarette tubes are stored in rows, lying flat in the boxes. The tobacco container and boxes are packaged together in a kit. The tobacco container and boxes can of course be separated and hence, misplaced. The box of cigarette tubes is normally of light paper weight construction which can be crushed.

The step of loading the tobacco into the cigarette tube filling device can result in considerable mess and wasted loose tobacco because the container for the loose tobacco is of a size to only accommodate the tobacco. On pulling tobacco from the container for use in the filling device, spillage of tobacco outside of the container can result.

In accordance with this invention, a packaging system is provided which overcomes several of the above problems and provides many unexpected advantages over these prior art systems.

SUMMARY OF THE INVENTION

In accordance with various aspects of this invention a packaging system is provided for hand made cigarettes which provides superior tobacco handling and improved cigarette tube storage all within a single canister.

In accordance with an aspect of the invention, the packaging system for loose tobacco and pre-made filter tipped cigarette tubes comprises:

i) a canister with removable lid having stored therein loose tobacco in its bottom portion; and ii) a container having stacked therein, a plurality of cigarette tubes in number at least equal to a number of cigarettes to be made from the loose tobacco;

iii) the cigarette tube container having an outer perimeter dimension which permits placement of the container in the canister on top of the tobacco with the removable lid in place on the canister.

Product identification in advertising may be placed on the periphery of the canister. The canister and optionally the container for the cigarette tubes can be reused for other purposes. They may be made of high quality, dishwasher safe plastics material.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
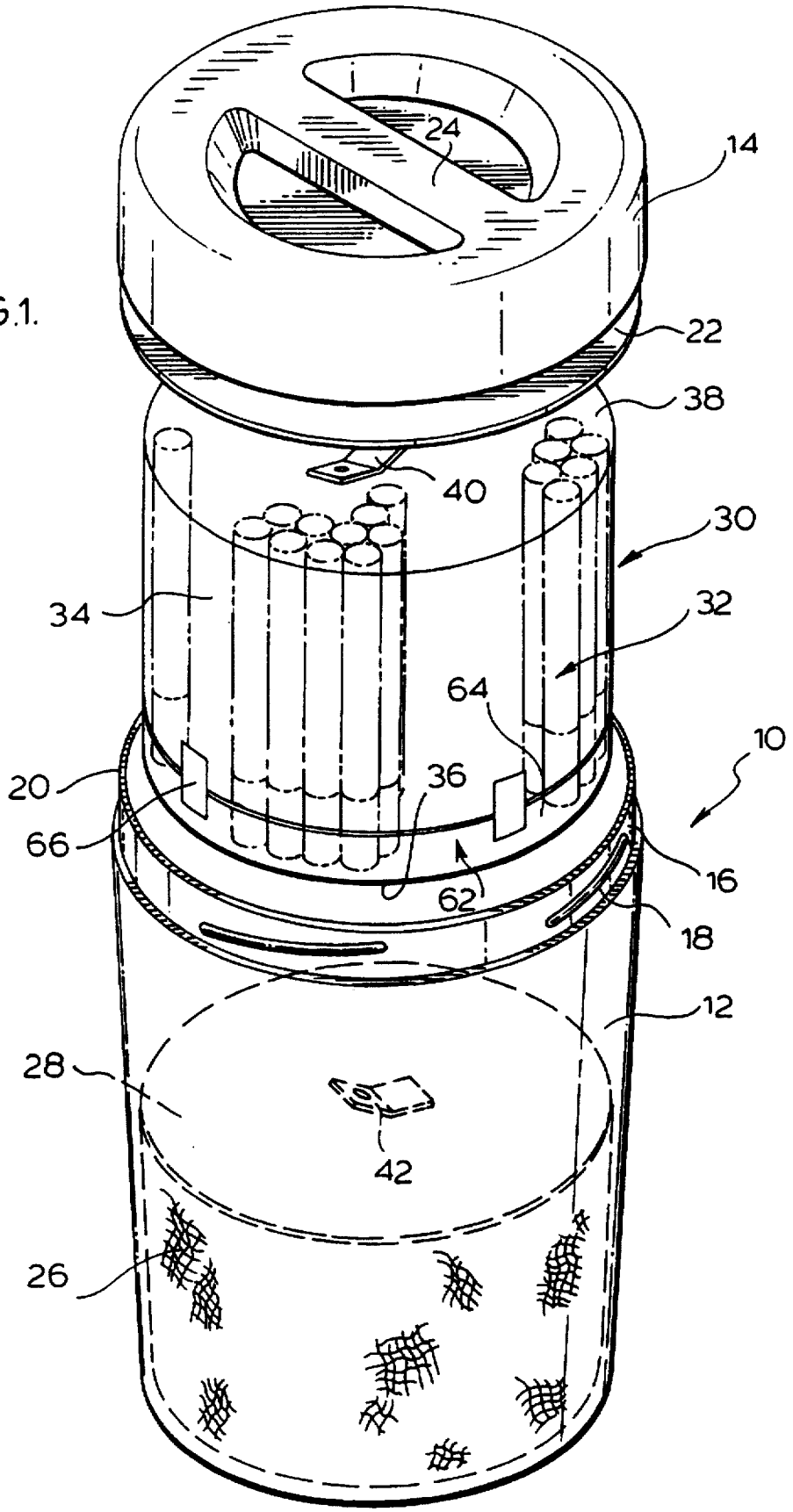
FIG. 1 is an exploded perspective view of the canister for loose tobacco and container of cigarette tubes.

A preferred embodiment of the packaging system of this invention is shown in FIG. 1. The packaging system 10 has a canister tub 12 and a twist-on canister lid 14. The tub 12 has a neck portion 16 with threads 18 for engaging the lid 14 to permit secure fastening of the lid to the tub. The neck 16 has an upper rim 20 which permits the heat sealing thereto of a suitable moisture, vapour and gas barrier or foil 22. The lid 14 during shipping is threaded onto the neck 16 over top of the barrier 22. The lid 14 includes a handle portion 24 which facilitates unthreading of the lid and removal from the tub. The tub has the fine cut loose tobacco charge 26 provided in the bottom thereof where preferably a suitable divider 28 is positioned on top of the tobacco charge.

A container 30 is provided for the pre-made filter tip cigarette tubes 32. The container 30 has a crush-proof wall 34 where the container is preferably inverted in the canister tub 12, with top wall 36 lowermost and bottom wall 38 uppermost. The cigarette tube container 30 is lowered into the tub 12 to rest on top of the divider 28. It is understood that if the divider is not used, the container 30 may rest directly on top of the tobacco 26. in order to remove the cigarette tube container from the tub 12, the seal 22 is broken after the lid 14 is removed. The cigarette tube container 30 is removed from the tube by grasping the handpull 40. In order to gain access to the tobacco 26, the divider 28 is removed by grasping handpull 42. It is appreciated that the handpull 40 or 42 may be of a variety of configurations while facilitating withdrawal of the container or divider when the tube 12 is in the upright position. It is also appreciated that the container could also be removed by pinching its upper edge and removing the container. The same technique may be used in removing the divider 28.

Figure 2:
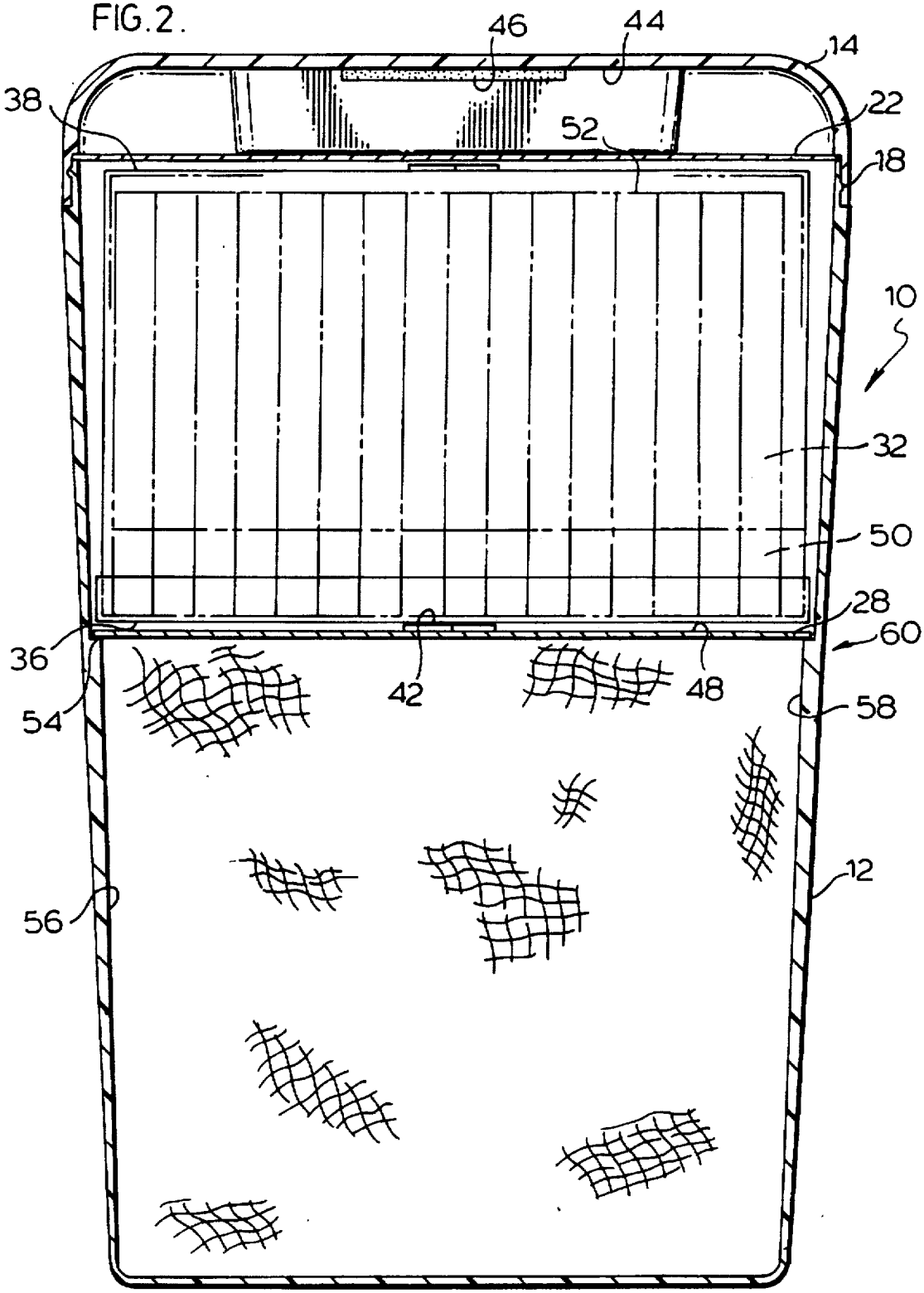
FIG. 2 is a section trough the assembled canister of FIG. 1.

The assembled packaging system 10 is shown in FIG. 2 where the lid 14 is secured to the container tub 12 by threaded engagement at 18. On the underside 44 of the lid within handle 24 is a pad of water absorbent material 46. After the canister is opened, a few drops of water may be placed on the pad 46 to keep the moisture content at the desired level to ensure that the tobacco 26 does not dry out. The cigarette tube container 30 rests on top of or above the divider 28 whereby pull 42 is compressed against the upper face 48 of the divider. In accordance with this embodiment, the divider 28 may rest on an annular shoulder 54 provided in the interior wall 58 of the tub in region 60. The height of the canister tub 12 is such that when the inverted container 30 is resting on the upper face 48 of the divider 28, the bottom 38 of container is below the level of the seal 22.

The individual cigarette tubes are stacked in the container 30. Assuming that the container is lying flat, the tubes are stacked in a vertical orientation that is they extend in a direction parallel to the longitudinal access of the container. The tubes may be positioned with the cigarette filter tip portion 50 being uppermost in the container 30 when the container is positioned in the canister or lowermost in the container. Such orientation of the cigarette tubes depends to some extent on the type of container used and how access is provided to the tubes after the container is removed from the canister. In accordance with the particular embodiment shown in FIG. 2, the individual cigarette tubes 32 have their filter tip portion 50 rest top wall 36 of inverted package 30. During shipping, storage and handling of the container 10 it has been found that the structurally stronger filter tip portion 50 of each cigarette tube supports the weight of the tube and hence, avoids crushing or misconfiguration of the much weaker cigarette tube open end 52.

The outer perimeter dimensions of One top 36 of the inverted container 30 is less than the inner diameter of the lower portion 56 of the tub 12 to permit placement of or resting of the container in the canister 12. Ideally, after the canister is opened, the divider 28 is discarded. Should one wish to store the cigarette tubes to avoid accidental crushing of the tubes or misplacement of the tubes, the tube container 30 can simply be placed back in the tube 12 to rest on top of the remaining tobacco 26. As the tobacco level decreases in the container, the cigarette tube container 30 slides down further within the tub 12 without binding and becoming stuck therein. Alternatively, the divider 28 may be retained and placed back in the tub on the shoulder 54 to support the cigarette tube container 30 in the inverted position above the loose tobacco.

The cigarette tube container 30 may be opened at its top 36 or bottom 38 in order to permit access to the cigarette tubes. In order to minimize tube open end damage, if the container is opened at its bottom 38, it is preferred that the bottom 38 come off in its entirety. This permits dumping of the tubes on a work surface so that they may be carefully picked up individually and loaded with tobacco. Alternately, the container may be opened at its top 36 to permit individual tube withdrawal by grasping the sturdier tube filter tip and extracting the tube from the container 30 in its now upright position. The opening for the container bottom 38 or top 36 may be in the form of a removable lid, a removal foil or the like. As shown in FIG. 1, the inverted container has a removable top 36 which is in the form of an end cap 62 with skirt 64 which friction fits over sidewall 34. Seals 66 hold the end cap 62 on the inverted container to prevent container end cap opening as the container is removed from the canister tub.

Figure 3:
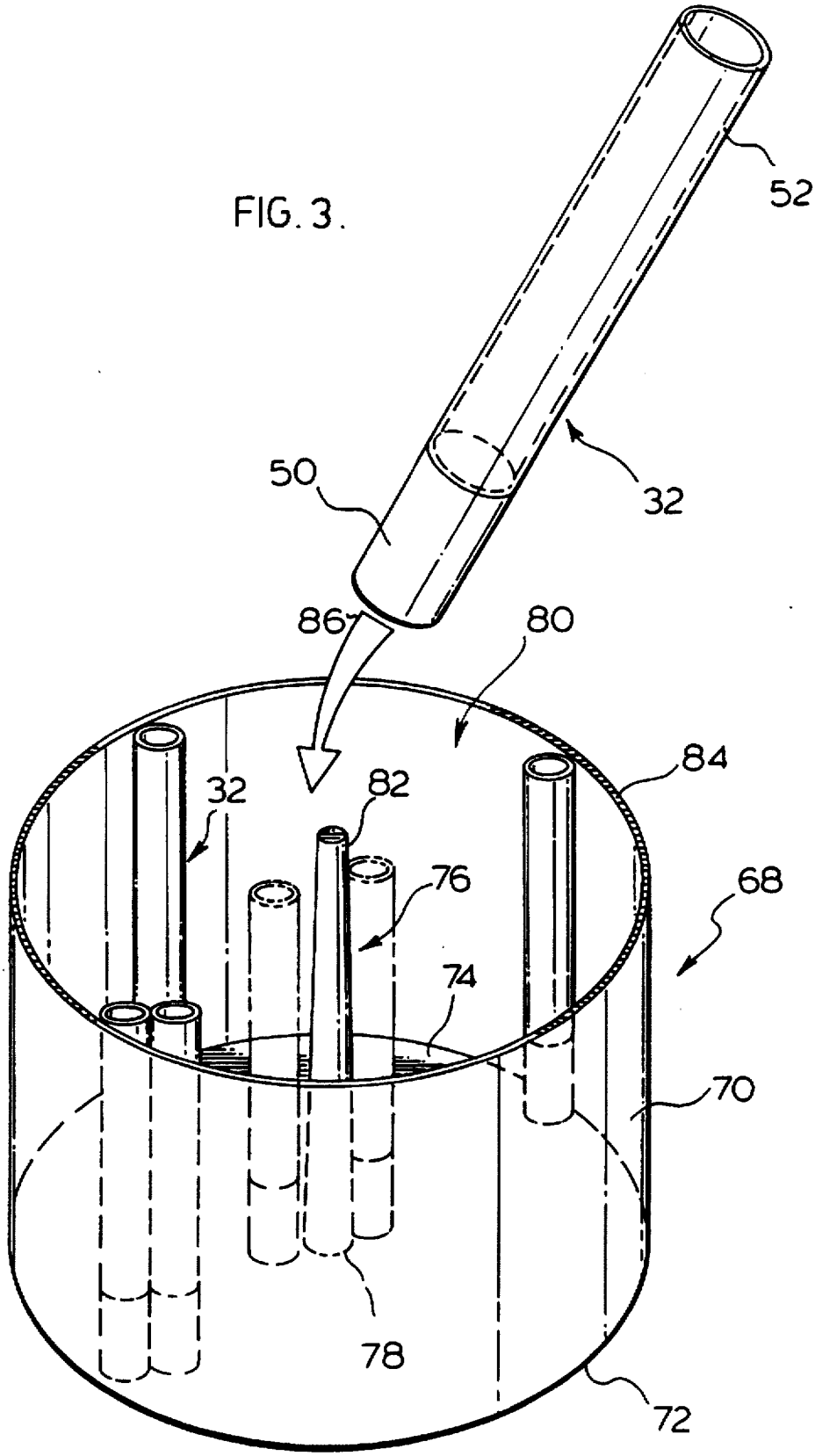
FIG. 3 is a perspective view of an alternative embodiment of the cigarette tube container.

An alternative embodiment for the cigarette tube container is shown in FIG. 3. The container 68 has peripheral sidewall 70 and flat bottom 72. A post 76 is provided on the upper surf ace 74 of the bottom 72 is a post 76. The post may be integral with or connected to the bottom 72 at juncture 78. The post is located centrally of the interior cavity 80 of the container. Preferably, the upper portion 82 of the post extends above the height of the rim 84 of the container wall 70. The cavity 80 of the container is filled with cigarette tubes 30 where in accordance with this preferred embodiment the filter tipped portions 50 are directed downwardly in the direction of arrow 86 to rest on the upper surface 74 of the bottom 72. The required number of cigarette tubes are then positioned within the cavity 80 to in essence fill the cavity before the tubes are placed within canister 12. The height of the upper portion 82 of the post 76 is such that it is below the level of the seal 22 when the packaging system 10 is complete and sealed. After the lid 14 is removed and the seal 22 discarded, the container 68 of cigarette tubes may be withdrawn from the canister by grasping the upper portion 82 of the post 76 to remove the container from the canister. The cigarette tubes 32 may be removed from the container 68 by delicately grasping the tube open end 52. This may be somewhat difficult. Hence, with this particular embodiment it may be preferable to simply dump the tubes out of the container 68 so that the tubes may be lifted by way of grasping the sturdier filter tip portion 50. After the cigarettes are made, they may be placed back in the container 68 which in turn may be stored in the canister with the lid closed to retain the desired moisture level in the cigarettes while they are being consumed over a period of time.

This form of packaging for loose tobacco and premade filter tip cigarette tubes provide many significant advantages and features. The system provides a reusable canister which is attractive in appearance. The exterior of the canister may be printed directly with advertising information or may have a removable printed sleeve applied to the exterior of the canister and which may be removed to facilitate reuse of the canister. The tobacco is packaged for freshness within the canister where the canister walls may be rigid and withstand any rough handling so as to avoid damage to the tobacco due to permeation of excessive moisture or other debris. The cigarette tube container 30 contains the cigarette tubes and preferably supports them in a manner which minimizes crushing of the cigarette tubes while making them readily available for use in hand making cigarettes. The seal 22 ensures overall freshness of the product and if the canister is packaged under slight vacuum, the characteristic ingress of air indicates product freshness to the consumer.

Although preferred embodiments of the invention have been described herein in detail, it will be understood by those skilled in the art that variations may be made thereto without departing from the spirit of the invention.

We claim:

1. A packaging system for loose tobacco and pre-made filter tipped cigarette tubes for use in hand making cigarettes comprising:

i) a canister with removable lid having stored therein loose tobacco in its bottom portion; and ii) a container having stacked therein a plurality of cigarette tubes in number at least equal to a number of cigarettes to be made from said loose tobacco, iii) said cigarette tube container having an outer perimeter dimension which permits placement of said container in said canister on top of said tobacco with said removable lid in place on said canister.

2. A packaging system of claim 1, wherein a divider is positioned on top of said loose tobacco, said cigarette tube container resting on said divider.

3. A packaging system of claim 1, wherein said cigarette tube container is inverted in said canister with a top of said container resting above said loose tobacco, said cigarette tubes being stacked in said container with filter tips of said tubes resting on said top of said container inverted in said canister.

4. A packaging system of claim 1, wherein said container has a central post attached to a bottom of said container with said post extending above said cigarette tubes whereby said post may be grasped to facilitate removal of said container from said canister.

5. A packaging system of claim 3, wherein a pull is provided on a bottom of said container inverted in said canister to facilitate removal of said container from said canister.

6. A packing system of claim 2, wherein said canister has an annular shoulder on its interior to support said divider above said loose tobacco.

* * * * *